US005298831A

United States Patent [19]

Amith

[11] Patent Number: 5,298,831

[45] Date of Patent: Mar. 29, 1994

[54] METHOD OF MAKING PHOTOCATHODES FOR IMAGE INTENSIFIER TUBES

[75] Inventor: Avraham Amith, Roanoke, Va.

[73] Assignee: ITT Corporation, New York, N.Y.

[21] Appl. No.: 825,115

[22] Filed: Dec. 31, 1985

[51] Int. Cl.[5] ..... H01J 31/00; H01J 31/26

[52] U.S. Cl. ..... 313/373

[58] Field of Search ..... 313/373, 374; 29/572

[56] References Cited

U.S. PATENT DOCUMENTS 3,982,261 9/1976 Antypas ..... 313/373
4,498,225 2/1985 Gutierrez et al. ..... 313/373

FOREIGN PATENT DOCUMENTS 1476471 6/1977 United Kingdom .
1526937 10/1978 United Kingdom .
1594947 8/1981 United Kingdom .
2094056 9/1982 United Kingdom .

*Primary Examiner*—Theodore M. Blum
*Attorney, Agent, or Firm*—Thomas N. Twomey; Patrick M. Hogan

[57] ABSTRACT

A method is provided of making a photoemissive cathode including bonding an electron emissive layer to a glass faceplate at an elevated temperature and pressure to form a cathode structure and cooling the cathode structure at a rate which will maintain stress between the electron emissive layer and the faceplate at or below a predetermined level in order to avoid brush marks and crosshatchings during subsequent processing steps. The cathode is cooled from a bonding temperature to room temperature in approximately twenty minutes or less.

6 Claims, 2 Drawing Sheets

METHOD OF MAKING PHOTOCATHODES FOR IMAGE INTENSIFIER TUBES

BACKGROUND OF THE INVENTION

This invention relates to image intensifier tubes and more particularly to photoemissive cathodes for use in such tubes.

Image intensifier tubes multiply the amount of incident light they receive and thus provide an increase in light output which can be supplied either to a camera or directly to the eyes of a viewer. These devices are particularly useful for providing images from dark regions and have both industrial and military application. For example, these devices are used for enhancing the night vision of aviators, for photographing extraterrestrial bodies and for providing night vision to sufferers of retinitis pigmentosa (night Blindness).

Image intensifier tubes utilize a photoemissive wafer which is bonded to a glass faceplate to form a cathode. Light enters the faceplate and strikes the wafer, thereby causing a primary emission of electrons from the opposite surface.

In forming the photoemissive cathode, it has been found that during heat cleaning of the cathode after the photoemissive wafer is bonded to the faceplate, cross-hatching marks and/or "brush lines" appear in the otherwise cosmetically uniform transparent cathode wafer. These marks destroy the usefulness of the cathode. They also occur at a point in the fabrication of the cathode at which considerable time, expense and materials have already been expended.

OBJECTS OF THE INVENTION

It is an object of the present invention to provide a method of making a finished cathode structure which does not exhibit cross-hatching and/or brush lines.

It is a further object of the present invention to reduce stress between a glass faceplate and a photoemissive wafer during a bonding and subsequent cooling process.

It is yet another object of the present invention to increase the effective setting point of the glass faceplate after the faceplate and the photoemissive wafer are subjected to a bonding temperature.

SUMMARY OF THE INVENTION

These objects and others which will become apparent hereinafter are accomplished by the present invention which provides a method of making a photoemissive cathode including bonding an electron emissive layer to a glass faceplate at an elevated temperature and pressure to form a cathode structure and cooling the cathode structure at a rate which will maintain stress between the electron emissive layer and the faceplate at or below a predetermined level.

BRIEF DESCRIPTION OF THE DRAWINGS

The above-mentioned and other features and objects of this invention will become more apparent by reference to the following description taken in conjunction with the accompanying drawings in which.

DETAILED DESCRIPTION OF THE PREFERRED EMBODIMENT

Figure 1:
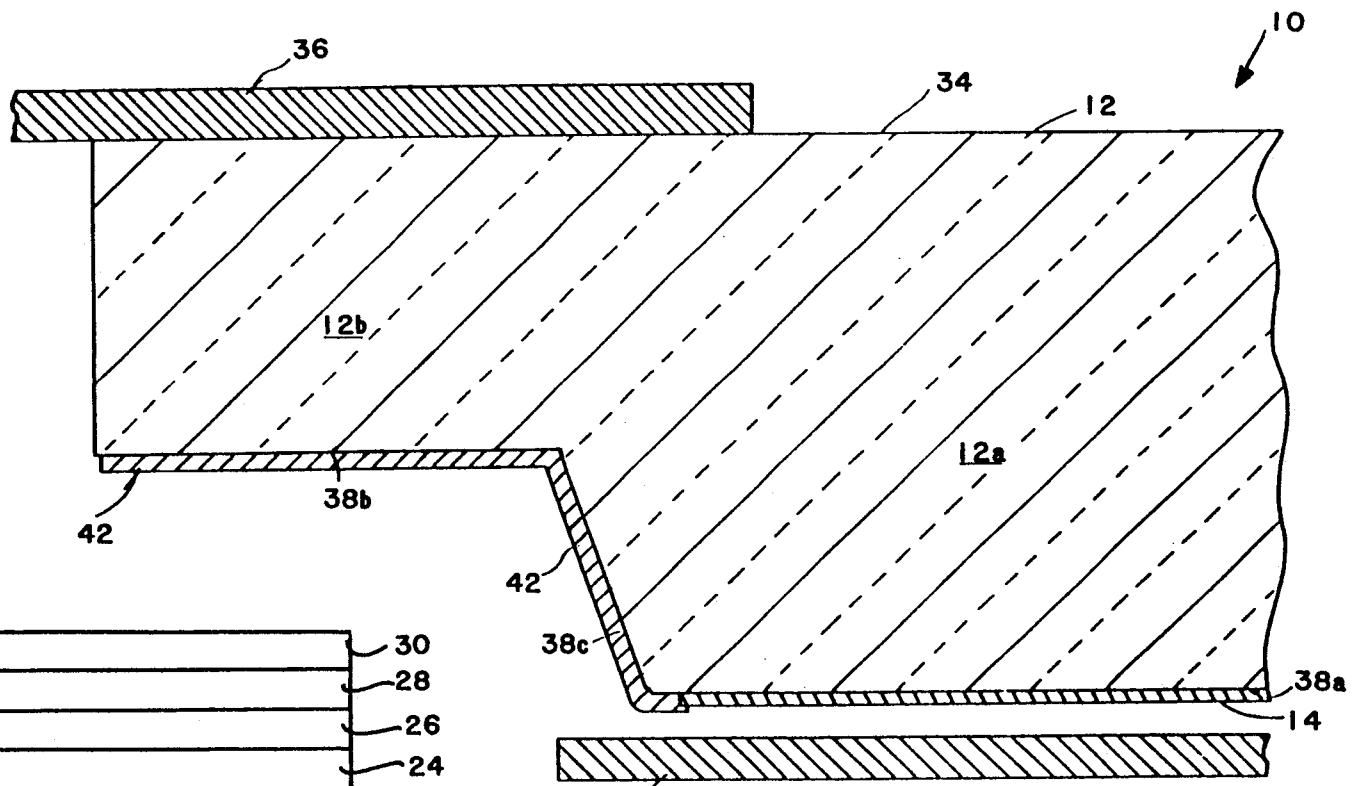
FIG. 1 is a cross-sectional view of a cathode usable in an image intensifier tube in accordance with this invention.

In FIG. 1 there is shown a cathode 10 formed in accordance with the process of this invention. The cathode 10 includes a faceplate 12 and a photoemissive wafer 14. The faceplate 12 can be made of a clear, high quality optical glass such as Corning 7056. This glass comprises 70 percent silica ($SiO_2$), 17 percent boric oxide ($B_2O_3$), 8 percent potash ($K_2O$), 3 percent alumina ($Al_2O_3$) and 1 percent each of soda ($Na_2O$) and lithium oxide ($Li_2O$). Other glasses may, of course, be used. In shape, the faceplate 12 includes a central, generally circular body portion **12*a* and a reduced thickness sill portion 12*b* in the form of a flange surrounding the body portion. One surface 34 of the faceplate 12 extends continuously across the body and sill portions 12*a* and 12*b*, respectively, and the portion of this surface extending over the sill portion 12*b* and a small adjacent portion of the central pody portion 12*a* fits under a flange 36 and is secured thereto to retain the faceplate 12 in a housing (not shown). The remainder of the portion of surface 34, that is, that portion surrounded by the flange 36 is the exposed surface of the faceplate 12** on which input light impinges.

The faceplate 12 also includes surface portions **38*a* and 38*b* which are generally parallel to surface 34 and which extend over the body portion 12*a* and sill portion 12*b*, respectively. Because of the difference in thickness between the body portion 12*a* and the sill portion 12*b*, the surface portions 38*a* and 38*b* lie in different planes with the portion 38*a* being spaced farther from the surface 34 than is the portion 38*b*. Extending between the surface portions 38*a* and 38*b* is a connecting surface portion 38*c*** which, in the embodiment disclosed herein, is generally frusto-conical.

The photoemissive wafer 14 is bonded to the surface portion **38*a* so that light impinging on the exposed portion of surface 34 and eventually striking the wafer 14 causes the emission of electrons. These electrons are accelerated across a gap by an electric field to a MCP 40 causing the secondary emission of electrons all in accordance with known principles. Connecting the photoemissive wafer 14 to an external biasing power supply (not shown) is a coating of conductive material 42 applied to the surfaces 16*b* and 16*c* and also over a portion of surface 16*a* so that this coating makes contact with the wafer 14**.

Figure 2:
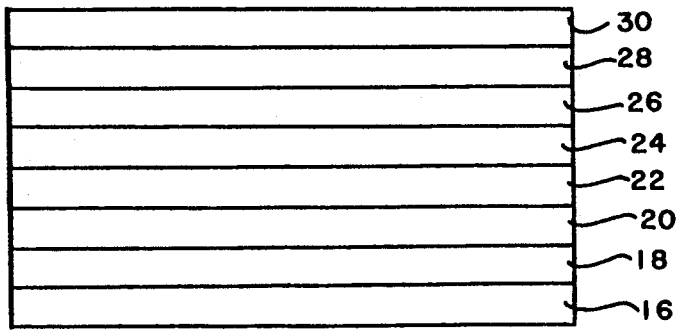
FIG. 2 is a cross sectional view of the wafer structure of the cathode of this invention as grown.

The photoemissive wafer 14 is formed in the following manner with reference to FIG. 2. A gallium arsenide (GaAs) substrate 16 has formed on one of its surfaces a layer 18 of gallium arsenide (GaAs) which is identified as a buffer layer. The formation of the buffer layer 18 is to facilitate control of a later etching process to remove the substrate. An etch stop layer 20 of gallium aluminum arsenide (GaAlAs) is formed on top of the buffer layer 18 and an active layer 22 of gallium arsenide (GaAs) is formed on the etch stop layer 20.

The active layer 22 has a layer of gallium aluminum arsenide (GaAlAs) formed on its surface and is identified as the window layer 24. Generally, formation of the wafer 14 results in a structure which is larger than that required for the image intensifier tube. One way of achieving the proper diameter for the wafer 14 is to cut the wafer with a saw. If this step is to be performed, then a cap layer 26 of gallium arsenide (GaAs) is formed on top of the window layer 24. This cap layer 26 will provide protection to the underlying structure during cutting to prevent chipping of the window layer 24.

Another way of achieving the proper wafer diameter is to carefully chip away the excess portions of the wafer 14 after it is bonded to the glass faceplate 12. In using this method, a cap layer is not necessary.

Preferably, the formation of each of the layers is by means of epitaxial growth.

If the cap layer 26 is used, it is removed after cutting, preferably by chemical means such as etching.

On the surface of the window layer 24 is deposited a thin layer 28 of silicon nitride ($Si_3N_4$). The silicon nitride layer 28 has a layer 30 of silicon dioxide ($SiO_2$) deposited on its surface. Both the silicon nitride layer 28 and the silicon dioxide layer 30 are preferably formed by sputter deposition. The structure so formed is the wafer 14.

The wafer 14 is positioned with the silicon dioxide layer 30 against the surface portion 38*a* of the faceplate 12. The wafer 14 is bonded to the faceplate 12 in a bonding apparatus to form a unitary structure. The temperature in the bonding apparatus is raised to approximately 630° C. and pressure is applied to the wafer 14 and the faceplate 12 for a length of time sufficient for bonding to occur to form a unitary structure. After bonding, the unitary structure is cooled.

The faceplate 12 and the wafer 14 have different thermal expansion characteristics. Therefore, elongation of the materials of the cathode 10 occurs at different rates, and the differential thermal expansion between the GaAs/GaAlAs material of the wafer 14 and the glass of the faceplate 12 cause stresses to be induced during the cooling stage after bonding near 630° C. These stresses appear as cross-hatchings and/or brush lines in the wafer 14 only during a subsequent heat cleaning process when the semiconductor layers 22, 24 are subject to extensive strain.

Prior to this invention, the temperature of the bonded unitary structure was slowly reduced to room temperature over a period of approximately 30 minutes. The initial cooling rate from near 630° C. was about 50° C. per minute for the first ten (10) minutes. As cooling occurred, the properties of the glass became "set" or frozen in at 477° C. which is identified as the setting point of the glass. Since the glass of the faceplate which is adjacent the wafer 14 is bonded to that wafer, the GaAs material of the wafer 14 was placed under tension from the setting point of the glass down to room temperature.

It has been found that cooling the bonded faceplate 12 and the wafer 14 at a faster rate results in raising the effective temperature of the setting point of the glass to approximately 510° C. With the setting temperature of the glass at that point, the GaAs material of the wafer 14 is placed under compression by the glass from that higher rate down to approximately 350° C. The wafer 14 is then under tension only from 350° C. to room temperature. Since the wafer 14 is under tension over a shorter temperature range, brush lines and cross-hatching marks will only appear at temperatures well above the heat cleaning temperature near 600° C. The processing steps subsequent to bonding do not involve subjecting the bonded structure to temperatures above the heat cleaning temperature and therefore lines and marks will not occur.

The properties of GaAs as a function of temperature are well defined. The properties of glass vis-a-vis temperature above the strain point are not well defined, but are a function of the rate at which glass is heated or cooled. If a glass is cooled too quickly, a great deal of stress is built up in the glass which is normally undesirable.

However, it has been found that cooling of the glass faceplate, having the GaAs wafer 14 bonded to it to room temperature over a period of approximately 20 minutes or less will prevent marks and lines from appearing at the heat cleaning temperature. The initial cooling rate from near 630° C. is about 150° C. per minute for the first five minutes.

Figure 3:
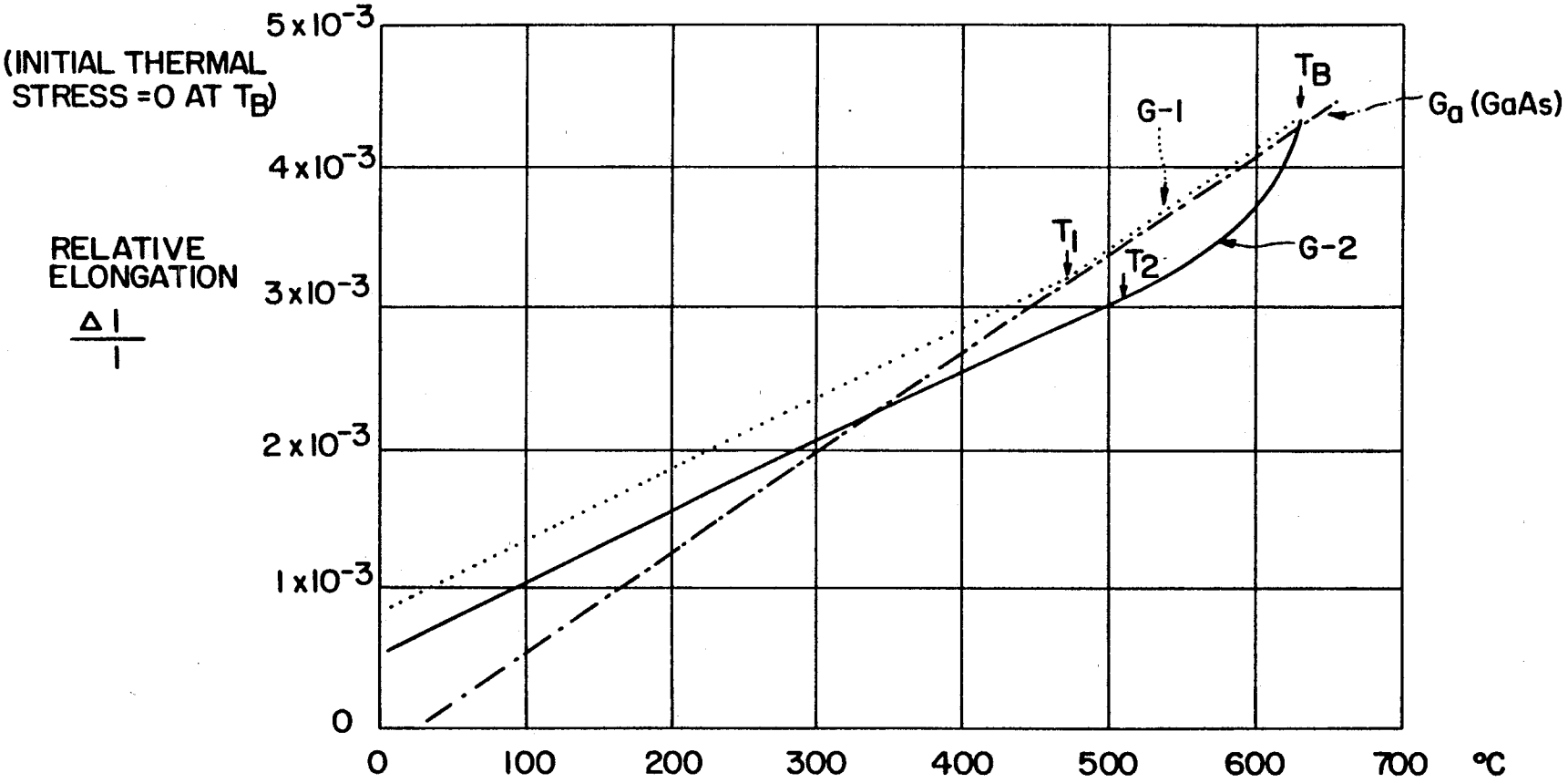
FIG. 3 is a graph showing relative elongation versus temperature of the faceplate and wafer.

Reference is now made to FIG. 3 which shows in graphic form the relationship between the glass of the faceplate and the gallium arsenide of the wafer prior to and after bonding. As can be seen, the thermal stress at the bonding temperature is zero. The setting point of the glass of the faceplate is at 477° C. (which is 5° C. above its strain point). The transformation range of the glass is between its strain point and its annealing point of approximately 512° C. If the glass by itself is cooled very slowly through its transformation range, its properties will be set rigidly at the setting point of 477° C.

It has been found that when the glass faceplate 12 and the wafer 14 are cooled very slowly from the bonding temperature $T_B$ (approximately 630° C.) then the glass layer close to the GaAs will cool along the curve G-1. It will move along the GaAs curve $G_a$, and at the setting point $T_1$ of 477° C. its properties would be frozen in. It will continue cooling along G-1, placing the GaAs under tension below 477° C.

However, when the glass which is close to the GaAs is cooled more rapidly in accordance with this invention, it cools along G-2, with its properties frozen at an effective setting point $T_2$ at 510° C., which is higher than 477° C. In this case, the GaAs will be under compression from that higher temperature $T_2$ down to about 300° C. (where G-2 and $G_a$ intersect). From there on down the GaAs will be under tension.

If cooling is forced to proceed still more rapidly (not shown), then the effective setting point will be higher than $T_2$, bringing it closer to the zero stress point of the bonding temperature.

The change in linear elongations of the glass and the GaAs wafer is represented by the $\Delta l/l$ slope which demonstrates relative elongation. The $\Delta l/l$ slope in the transformation range is high, as is characteristic of a liquid. If the glass is cooled at a fast rate, the glass will be brought into a lower $\Delta l/l$ slope which is characteristic of a solid. In this case, the outer layer of the glass will be under strong compression due to the slower cooling interior of the glass.

It can be seen from curve G-1 that under very slow cooling through the transformation range of the glass, the layer of the glass close to the wafer 14 tries to relieve strain with respect to the wafer and also with respect to the slower cooling interior of the glass, resulting in stresses which appear as marks or lines in subsequent processing.

By cooling rapidly as represented by G-2, the glass is "set" at a higher temperature than is possible by slow cooling. Then upon heat cleaning the glass curve (not shown in the FIG. 3) will go above the GaAs curve at a higher temperature and thus subject the GaAs to tension only at a higher temperature than previously possible with the slow cooling rate.

Following cooling, the GaAs substrate 16 is removed. This is preferably done by lapping off most of the substrate 16 by mechanical polishing. The remaining portion of the substrate 16 is thereafter removed by chemical etching. The buffer layer 18 and the etch stop layer 20 are also removed, preferably by a chemical etching process. The structure is now identified as the cathode 10.

The conductive coatings 42 are applied to the surface portions 38*b* and 38*c* and a small portion of 38*a* which is contiguous with 38*c*.

The cathode 10 is then heat cleaned to remove surface contaminants. The cathode 10 is placed in an ultra-high-facuum chamber and is heated to a temperature of approximately 600° C. At this temperature, contaminants such as oxygen and carbon are freed from the cathode 10 and are removed by the vacuum system. The heat is provided by means of a lamp, although any other suitable source is acceptable. The heat cleaning temperature of 600° C. is only approximate and is dependent upon the actual percentage of gallium and arsenic at the surface.

The cathode 10 is then placed in the housing of the image intensifier tube.

While I have described above the principles of my invention in connection with specific apparatus, it is to be clearly understood that this description is made only by way of example and not as a limitation to the scope of my invention as set forth in the objects thereof and in the accompanying claims.

What is claimed is:

1. A method of making a photoemissive cathode comprising the steps of:

providing a glass faceplate;

forming an electron emissive layer;

bonding the electron emissive layer to the glass faceplate at an elevated temperature and pressure to form a cathode structure; and cooling the cathode structure at a rate which will maintain stress between the electron emissive layer and the faceplate at a predetermined level, said step including bringing the cathode structure from the elevated bonding temperature to room temperature in a period of time less than twenty minutes.

2. The method of claim 1 wherein the bonding step includes raising the temperature to approximately 630° C.

3. The method of claim 1 wherein bring the cathode structure from the elevated bonding temperature to room temperature is performed in approximately 15 minutes.

4. A method of forming a cathode structure comprising the steps of:

bonding a photoemissive layer to a transparent faceplate at an elevated temperature and pressure; and cooling the bonded structure from the elevated temperature to room temperature at a rate at which the photoemissive layer is maintained under compression during a temperature drop of approximately 160° C.

5. A method of forming a cathode having a transparent faceplate and a photoemissive layer bonded thereto, comprising the step of:

cooling the faceplate and the photoemissive layer from a bonding temperature to room temperature at a rate which places the setting point of glass at approximately 510° C.

6. A method of forming a cathode having a transparent faceplate and a photoemissive layer bonded thereto, comprising the step of:

cooling the faceplate and the photoemissive layer from a bonding temperature to room temperature said cooling step taking place at an initial cooling rate of 150° C. per minute for the first five minutes.

* * * * *